US008960407B2

(12) United States Patent
Braasch et al.

(10) Patent No.: US 8,960,407 B2
(45) Date of Patent: Feb. 24, 2015

(54) SIGNAL CORRELATION FOR MISSING STEP DETECTION IN CONVEYORS

(75) Inventors: Burkhard Braasch, Berlin (DE); Ingo Engelhard, Berlin (DE); Dirk H. Tegtmeier, Berlin (DE); Peter Herkel, Berlin (DE); Ralph S. Stripling, Berlin (DE); Frank Kirchhoff, Berlin (DE)

(73) Assignee: Otis Elevator Company, Farmington, CT (US)

( * ) Notice: Subject to any disclaimer, the term of this patent is extended or adjusted under 35 U.S.C. 154(b) by 628 days.

(21) Appl. No.: 13/260,515

(22) PCT Filed: Apr. 20, 2009

(86) PCT No.: PCT/US2009/041123

§ 371 (c)(1),
(2), (4) Date: Sep. 26, 2011

(87) PCT Pub. No.: WO2010/123490

PCT Pub. Date: Oct. 28, 2010

(65) Prior Publication Data

US 2012/0103756 A1 May 3, 2012

(51) Int. Cl.
*B66B 25/00* (2006.01)
*B66B 29/00* (2006.01)

(52) U.S. Cl.
CPC ..... *B66B 29/005* (2013.01); *B66B 25/003* (2013.01)
USPC ..... 198/323

(58) Field of Classification Search
CPC ..... B65G 43/04; B66B 29/005; B66B 29/04
USPC ..... 198/323
See application file for complete search history.

(56) References Cited

U.S. PATENT DOCUMENTS

| | | | |
|---|---|---|---|
| 4,631,467 | A | 12/1986 | Herrmann et al. |
| 4,863,006 | A | 9/1989 | Kotkata et al. |
| 5,096,040 | A | 3/1992 | Wente et al. |
| 5,316,121 | A | 5/1994 | Zaharia et al. |
| 5,361,887 | A | 11/1994 | Zaharia et al. |
| 5,467,658 | A | 11/1995 | Buckalew et al. |

(Continued)

FOREIGN PATENT DOCUMENTS

| | | | |
|---|---|---|---|
| CN | 1273213 | A | 11/2000 |
| CN | 201321333 | Y * | 10/2009 |

(Continued)

OTHER PUBLICATIONS

Craig McIntyre, Safety Under Pressure—Sensor Considerations in a safety instrumented system, ISA.org, Published Jun. 1, 2005.

(Continued)

*Primary Examiner* — Gene Crawford
*Assistant Examiner* — Lester Rushin
(74) *Attorney, Agent, or Firm* — Miller, Matthias & Hull LLP

(57) ABSTRACT

A device and method for detecting a misaligned or missing step of a conveyor are disclosed. The missing step detector includes various sensors for detecting the drive speed of the conveyor and for detecting the presence of pallets or steps. The sensor output signals are correlated to determine fixed values characteristic of the specific conveyor in question. Using the fixed values as reference, the missing step detector is able to effectively monitor the conveyor for misaligned or missing steps independent of conveyor speed and time.

17 Claims, 7 Drawing Sheets

(56) References Cited

U.S. PATENT DOCUMENTS

| | | | | |
|---|---|---|---|---|
| 5,564,550 | A | 10/1996 | Van Rooy et al. | |
| 5,610,374 | A | 3/1997 | Boom et al. | |
| 5,708,416 | A | 1/1998 | Zaharia et al. | |
| 5,819,910 | A | 10/1998 | Langer et al. | |
| 5,886,497 | A | 3/1999 | Zaharia et al. | |
| 6,016,902 | A | 1/2000 | Kwon | |
| 6,049,189 | A | 4/2000 | Markus et al. | |
| 6,112,166 | A | 8/2000 | Joosten | |
| 6,351,096 | B1 | 2/2002 | Jang | |
| 6,637,579 | B2 | 10/2003 | Pietz | |
| 6,892,874 | B2 | 5/2005 | Pietz | |
| 6,971,496 | B1 | 12/2005 | Nurnberg et al. | |
| 7,225,912 | B1 | 6/2007 | Toennisson et al. | |
| 7,296,671 | B2 | 11/2007 | Pietz | |
| 2003/0000798 | A1 | 1/2003 | Williams et al. | |
| 2003/0221934 | A1 | 12/2003 | Pietz | |
| 2005/0016817 | A1 | 1/2005 | Pietz | |
| 2005/0279611 | A1 | 12/2005 | Ossendorf et al. | |
| 2011/0011700 | A1* | 1/2011 | Plathin et al. | 198/323 |
| 2012/0116574 | A1* | 5/2012 | Kangas et al. | 700/230 |
| 2012/0283870 | A1* | 11/2012 | Senger et al. | 700/230 |

FOREIGN PATENT DOCUMENTS

| | | | |
|---|---|---|---|
| DE | 2346266 | A1 | 3/1975 |
| EP | 0534400 | | 3/1993 |
| EP | 0599452 | | 6/1994 |
| EP | 0826623 | | 3/1998 |
| EP | 0750585 | B1 | 5/1999 |
| EP | 0703183 | B1 | 5/2001 |
| EP | 1289871 | | 3/2003 |
| EP | 1634843 | | 3/2006 |
| EP | 1874669 | B1 | 1/2008 |
| GB | 2175761 | A | 12/1986 |
| JP | 7-101658 | A | 4/1995 |
| JP | 07257866 | A | 10/1995 |
| JP | 2001114488 | A | 4/2001 |
| JP | 2002241072 | A | 8/2002 |
| JP | 2003118965 | A | 4/2003 |
| JP | 2005343625 | A | 12/2005 |
| JP | 2006182509 | A | 7/2006 |
| WO | WO 95/25061 | | 9/1995 |
| WO | WO 98/18711 | | 5/1998 |
| WO | WO 01/94248 | A1 | 12/2001 |
| WO | WO 2006/018032 | A1 | 2/2006 |
| WO | WO 2006/094524 | A1 | 9/2006 |

OTHER PUBLICATIONS

Office Action issued in counterpart Japanese Patent Application No. 2012-507185; Office Action dated Aug. 1, 2013.

* cited by examiner

SIGNAL CORRELATION FOR MISSING STEP DETECTION IN CONVEYORS

CROSS-REFERENCE TO RELATED APPLICATIONS

This application is a U.S. national stage filing of International Patent Application No. PCT/US09/41123, filed on Apr. 20, 2009.

FIELD OF THE DISCLOSURE

The present disclosure generally relates to safety control systems for conveyors, and more particularly, relates to devices and methods for detecting a missing step of a conveyor.

BACKGROUND OF THE DISCLOSURE

Conveyors, such as escalators, travelators, moving walkways, and the like, provide a moving pathway to quickly and conveniently transport people from one location to another. More specifically, the moving pallets or steps of a conveyor move passengers along the length of the pathway between two landing platforms at predetermined rates of speed. Step chains hidden from view and disposed underneath the conveyor serve to interconnect each of the steps in a closed loop fashion. Driven by a main drive source, drive shafts and associated sprockets, the step chains move the steps along an exposed upper surface of the conveyor to transport passengers between the landing platforms. Sprockets disposed within each of the two landing platforms guide the step chains through an arc to reverse the direction of step movement and to create a cyclic return path.

Because of their continual motion, conveyors are prone to various internal failures, which may further cause injury to passengers on or near the conveyor. One of these failures pertains to misaligned or missing pallets or steps. Over time, one or more steps of a conveyor may break loose from the associated step chains causing the steps to drop or fall within the conveyor system undetected. Missing steps may also be caused by improper maintenance. Conveyors require periodic maintenance in which one or more steps may be removed, replaced, or the like. However, if a step is not properly fastened or realigned with the step chains, the step may break loose and fall. In any event, if a control system of a conveyor fails to detect a void caused by a missing step, the conveyor may continue to operate, advance the void to the upper surface of the conveyor and expose the void to passengers. Unknowing passengers may fall or step into the void and become injured. The issue of missing pallets or steps and the detection thereof is therefore well known in the art of conveyors. While there are several existing systems which provide such safety control measures for conveyors and aim to accurately detect such faults, they have their drawbacks.

Safety control systems for conveyors exist in which electromechanical switches are used to detect steps or the lack thereof. Such systems position electromechanical switches within the return path of the conveyor so as to detect a misaligned or an unsupported step. Due to gravity, an unsupported step in the return path may swing away or hang from the step chains and place the step directly in the path of the electromechanical switches. However, such electromechanical switches are unable to function properly if the step is grossly out of position or completely detached from the step chains altogether. Additionally, such electromechanical switches are significantly more prone to wear and are unreliable.

Other missing step detection systems implement photoelectric sensors which use light or the interruption thereof to monitor the steps of a conveyor. In such systems, each step of the conveyor is required to have a through-hole fully extending through the width of the step. A photoelectric beam of light is then aligned to pass directly through the hole of a step when the step is properly aligned and supported by the step chains. If a step is misaligned, the beam of light is interrupted and the control system responds to the error. One disadvantage with such a scheme is that each of the steps requires significant modifications to adapt for such photoelectric sensors, and therefore, cannot be retrofit onto conveyors that carry steps without through-holes. Furthermore, safety control systems for conveyors using photoelectric sensors are susceptible to dust, debris, or anything else that may be present or that may be present or that may collect in the through-holes over time and interrupt the light paths.

Yet another existing missing step detection system employs proximity sensors which constantly detect the presence of each passing step in the return path. Such sensors electromagnetically interact with the metal in the passing step to output a corresponding voltage or current indicating the presence or absence of the passing step. However, in cases where the steps are modified for plastic or rubber inserts, there is insufficient metal to be accurately and reliably detected by the sensors. In general, conveyor safety control systems which use proximity sensors require significant modifications to the configuration of the steps. Some proximity sensor driven safety control systems may require the top surfaces of the steps to be aligned in a linear fashion in the return path. Other systems may require the side surfaces of the steps to be linear or flat.

Among the more common proximity sensors used for detecting missing steps are capacitive and inductive sensors. Capacitive sensors continuously measure a difference in voltage, or the electric field that is formed by the sensor itself. When in close proximity to the sensor, the metal of passing steps offsets the electric field, creates a difference in voltage, and causes the sensor to output a signal corresponding to the change in the electric field. However, capacitive sensors are easily affected by sources other than the metal of a passing step, such as dust, dirt or even humidity in the air, and therefore, the electrical signals output by capacitive sensors are generally unreliable.

Many systems also implement inductive proximity sensors which are robust and more reliable than capacitive sensors. Inductive sensors continuously monitor the level of current flowing through an inductive loop within the sensor. When in close proximity to the sensor, the metal of passing steps significantly alters the current flow in the inductive loop, and causes the sensor to output a signal corresponding to the change in the inductance. As with capacitive sensors, inductive sensors output continuous signals which require an associated control system to monitor the continuous signals output by a capacitive or an inductive sensor. However, according to new standards and safety regulations for conveyor systems, safety control systems which monitor continuous signals must also incorporate costly certified sensors which gauge the integrity of the proximity sensors.

Additionally, missing step detection systems which use proximity sensors and rely on continuous signal output are dependent on parameters that are not fixed or constant, such as conveyor speed and time. For instance, using the speed of the conveyor as a frame of reference, the system sets forth an expected timeframe or window at which the next consecutive step is to be detected by the proximity sensor. From a signal processing standpoint, the proximity sensors are outputting continuous detection signals and the expected window is rather broad and vague. This makes it more difficult for the control system to accurately filter out the unwanted noise from the desired detection signal, and make an accurate decision based on the filtered signal. Furthermore, while this method may be effective when the conveyor is moving at constant speeds, it is unreliable when the conveyor is accelerating, decelerating, turned on or turned off.

Therefore, there is a need for robust safety control systems which detect misaligned or missing steps accurately, reliably and cost effectively, while in full compliance with the current safety standards and regulations. More specifically, there is a need for a missing step detection system for a conveyor which does not require costly certified sensors and is redundant, or provides its own self-check. Furthermore, there is a need for a missing step detection system that provides alternating output signals with less noise, and correlates sensor output signals to result in fixed reference values that are independent to conveyor speed and time.

SUMMARY OF THE DISCLOSURE

In accordance with one aspect of the disclosure, an apparatus for detecting a missing or misaligned step of a conveyor extending between a first platform and a second platform is provided. The apparatus comprises at least one drive speed sensor configured to detect a drive speed and output a drive pulse signal corresponding to the drive speed; at least one first step sensor and at least one second step sensor, the first step sensor configured to detect each step at the first platform and outputting a first step pulse signal corresponding to the steps at the first platform, the second step sensor configured to detect each step at the second platform and outputting a second step pulse signal corresponding to the steps at the second platform; and a control unit that receives the drive pulse signal and first and second step pulse signals, the control unit being configured to determine a frequency of the drive pulse signal, determine a ratio of drive pulses per step pitch, determine a phase difference between the first and second step pulse signals, monitor the pulses per step pitch ratio and the step pulse signal phase difference for variance, and provide instructions to adjust operation of the conveyor in response to detected variance.

In accordance with another aspect of the disclosure, a method for detecting a missing or misaligned step of a conveyor extending between a first platform and a second platform is provided. The method comprises the steps of determining a drive pulse signal corresponding to a speed of the conveyor; determining a first step pulse signal corresponding to the steps at the first platform; determining a second step pulse signal corresponding to the steps at the second platform; determining a ratio of drive pulses per step pitch; determining a phase difference between the first and second step pulse signals; monitoring each of the pulses per step pitch ratio and the step pulse signal phase difference for variance; and providing instructions to adjust operation of the conveyor in response to detected variance.

These and other aspects of this disclosure will become more readily apparent upon reading the following detailed description when taken in conjunction with the accompanying drawings.

Figure 1:
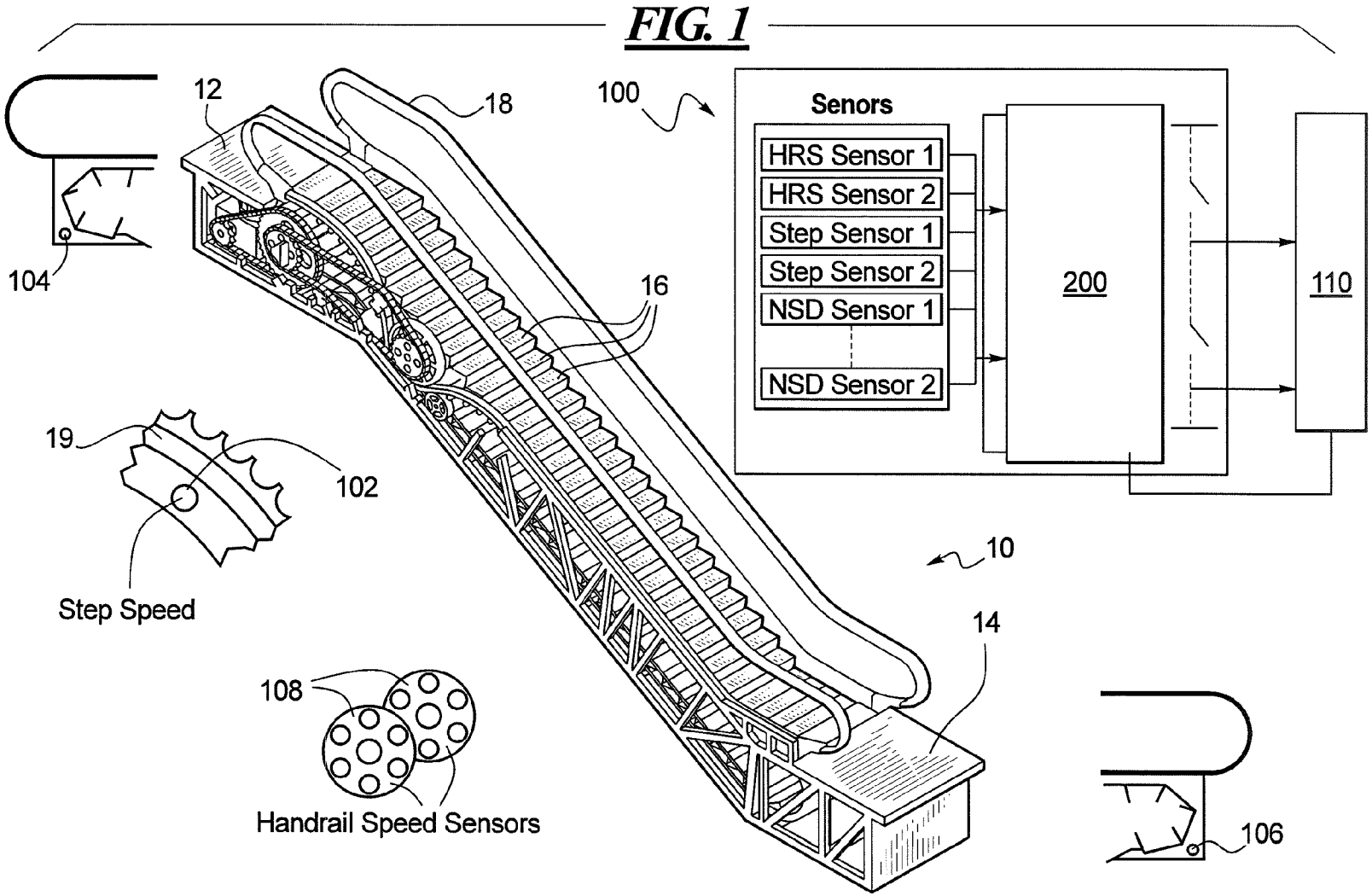
FIG. 1 is a perspective view of a conveyor incorporating an exemplary safety control system for detecting missing steps constructed in accordance with the teachings of the disclosure.

While the present disclosure is susceptible to various modifications and alternative constructions, certain illustrative embodiments thereof have been shown in the drawings and will be described below in detail. It should be understood, however, that there is no intention to be limited to the specific forms disclosed, but on the contrary, the intention is to cover all modifications, alternative constructions, and equivalents falling with the spirit and scope of the present disclosure.

DETAILED DESCRIPTION

Referring to the drawings and with particular reference to FIG. 1, an exemplary safety control system, or more particularly, a missing step detection apparatus for a conveyor is provided and referred to as reference number 100. It is understood that the teachings of the disclosure can be used to construct safety control systems and devices for detecting missing conveyor steps above and beyond that specifically disclosed below. One of ordinary skill in the art will readily understand that the following are only exemplary embodiments.

As shown in FIG. 1, an exemplary conveyor 10 in the form of an escalator is provided having a first platform 12, a second platform 14, a plurality of moving pallets or steps 16 extending between the first and second platforms 12, 14, as well as moving handrails 18 disposed alongside the plurality of steps 16. The steps 16 of the conveyor 10 are driven by a main drive source (not shown), such as an electric motor, or the like, and are caused to move between the platforms 12, 14. The main drive source rotates a drive shaft and associated gears to rotate closed loop step bands or chains which mechanically interconnect the inner surfaces of the steps 16 from within the conveyor 10. Within each of the two landing platforms 12, 14, sprockets 19 guide the step chains and the attached steps 16 through an arc to reverse the direction of step movement and to create a return path in a cyclic manner. The handrails 18 are rotatably moved by similar means alongside the steps 16 at a speed comparable to that of the steps 16.

Figure 2:
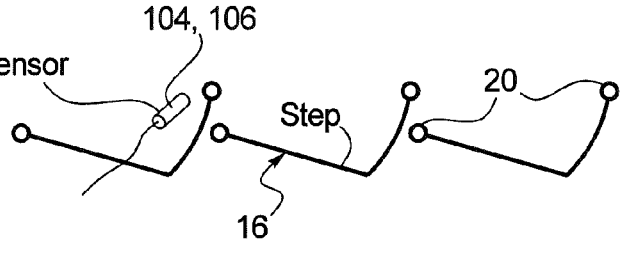
FIG. 2 is a schematic of steps in a return path approaching a landing platform.

Still referring to FIG. 1, the conveyor 10 may be provided with safety control means such as the missing step detection device 100 shown. The missing step detector 100 may provide a plurality of sensors and a control unit 200 for observing various parameters of the conveyor 10. In particular, the missing step detector 100 may observe the drive speed of the conveyor 10, the speed of the handrail 18, the presence of steps 16 in relation to each of the landing platforms 12, 14, and the like. To determine the conveyor or drive speed, the missing step detector 100 may provide a drive speed sensor 102. The drive speed sensor 102 may comprise one or more inductive sensors positioned in close proximity to the teeth of the sprockets 19 which drive the step chain interconnecting the steps. Alternatively, the drive speed sensor 102 may comprise photoelectric sensors or an encoder positioned on an axis of the sprocket 19 configured to detect the rotational velocity of the sprocket 19. To accurately detect the presence or absence of steps 16, the missing step detector 100 may include step roller sensors 104, 106 in the landing platforms 12, 14 of the conveyor 10. In particular, the step roller sensors 104, 106 may comprise proximity sensors configured to detect the metal in the step roller or step roller axes 20, as shown in FIG. 2. The missing step detector 100 may also include handrail sensors 108 to observe the rate of speed of the handrails 18. The missing step detector 100 monitors the sensor readings, or signal correlations of the sensor readings, for any significant variance and signs of fault. Once a variance or a fault has been detected, the missing step detector 100 may provide the necessary instructions for adjusting the operation of the conveyor 10 accordingly. For example, if the missing step detector 100 detects a critical fault, the missing step detector 100 may output the necessary instructions or control signals to an associated conveyor controller 110 in order to slow down or stop the conveyor 10.

Figure 3:
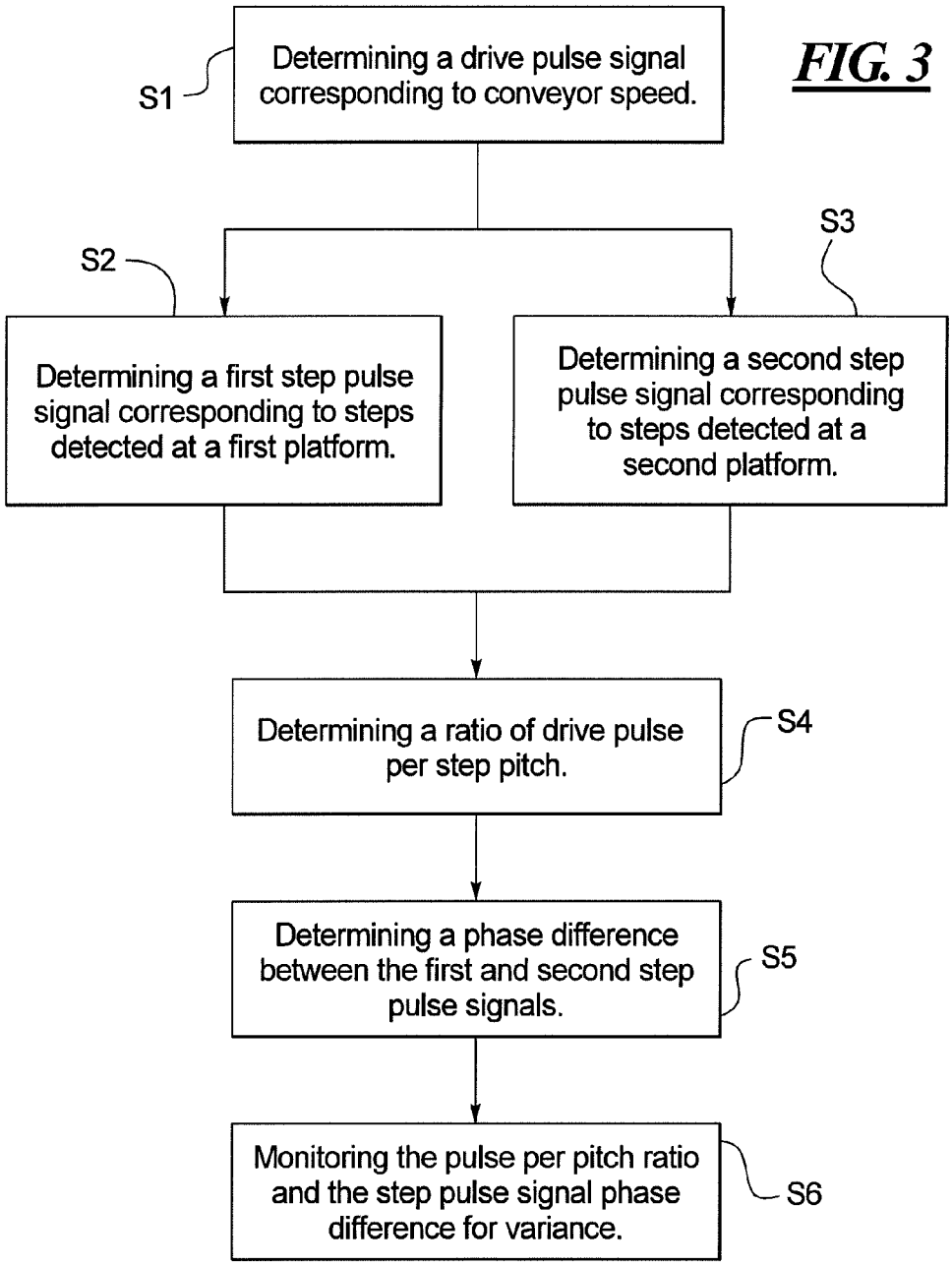
FIG. 3 is a flow chart of an exemplary method for detecting missing steps in a conveyor.

As illustrated in the flow chart of FIG. 3, the missing step detector 100 correlates the output signals provided by the sensors in order to overcome the drawbacks associated with time dependent step detection processes of the prior art. More specifically, the missing step detector 100 initially determines an alternating drive pulse signal representative of the conveyor drive speed and corresponding to the output of the drive speed sensor 102 in a step S1. The missing step detector 100 may also determine a first step pulse signal representative of the steps 16 detected by the step roller sensor 104 of a first landing platform 12 in a step S2. Similarly, the missing step detector 100 may determine a second step pulse signal corresponding to the steps 16 detected by the step roller sensor 106 of a second landing platform 14, as in step S3. From these pulse signals, the missing step detector 100 is capable of determining fixed values or characteristics that are specific to the conveyor 10 in question. As indicated as step S4 in FIG. 3, the missing step detector 100 may determine a ratio between the number of pulses in the drive pulse signal per step 16 or step pitch. This ratio is a fixed value or characteristic associated with the particular conveyor 10 and does not vary with conveyor speed or time. The missing step detector 100 may also determine a phase difference between the first and second step pulse signals corresponding to the two platforms 12, 14, as shown in step S5. The phase difference is another fixed value associated with the conveyor 10 and does not vary with conveyor speed or time. In a subsequent step S6, the missing step detector 100 may monitor both the pulses per pitch ratio and the phase difference between the first and second step pulse signals for any variance. It is possible to correlate the pulse signals to result in fixed values because there is a fixed relationship between the rotational velocity of the main drive shaft and the instance at which the next step roller or roller axis 20 is detected. Accordingly, the missing step detector 100 is able to effectively detect missing steps at all instances of operation without regard to conveyor speed, acceleration, deceleration, and so forth. Furthermore, by relying on more than one relationship and creating redundancy, the missing step detector 100 is more likely to detect a true fault and less likely to trigger a false positive.

Figures 4A, 4B:
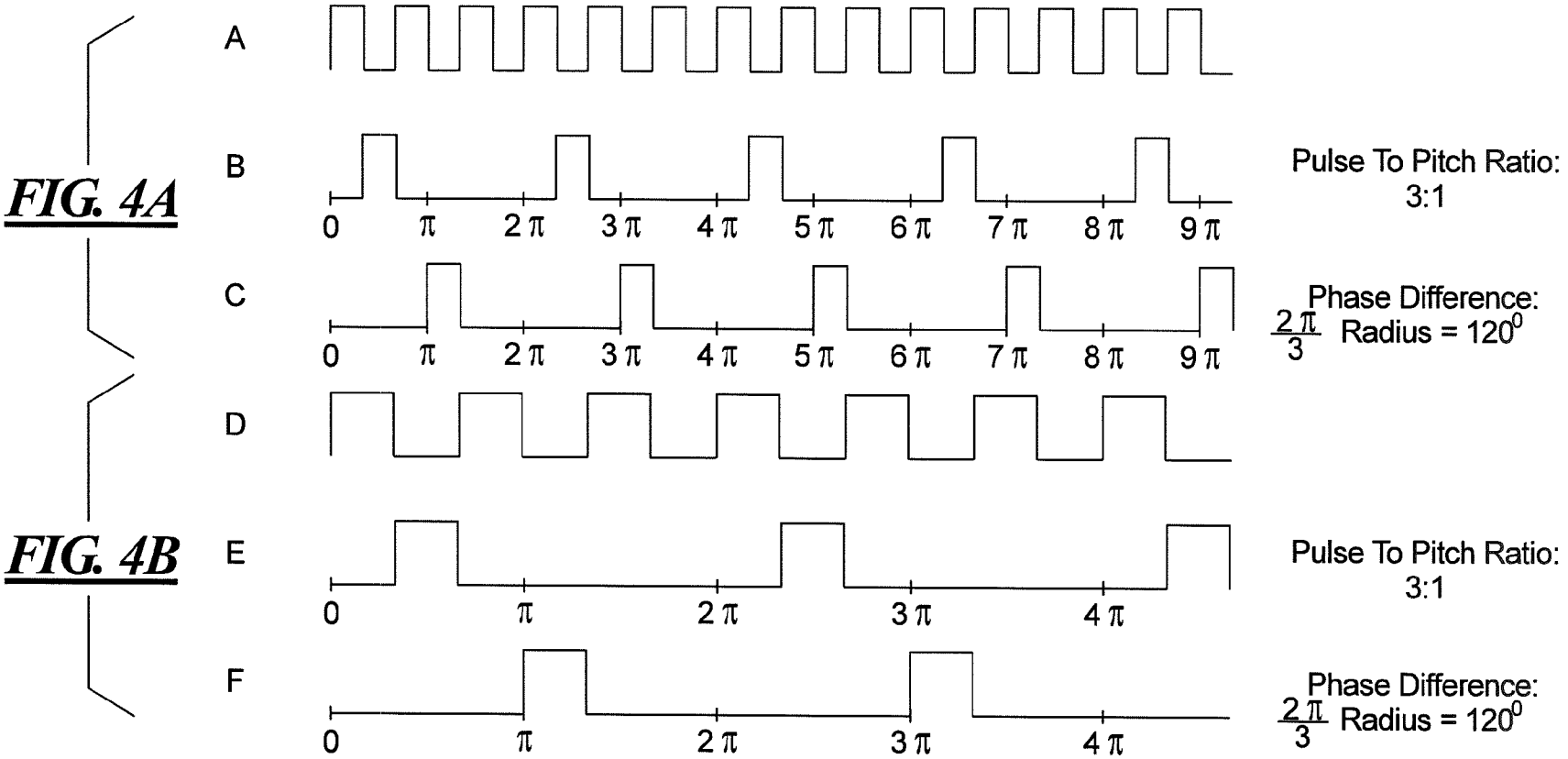
FIGS. 4A-4B are schematic timing diagrams of pulse signals as output by various sensors at a first conveyor speed and at a second conveyor speed.
Figure 5A:
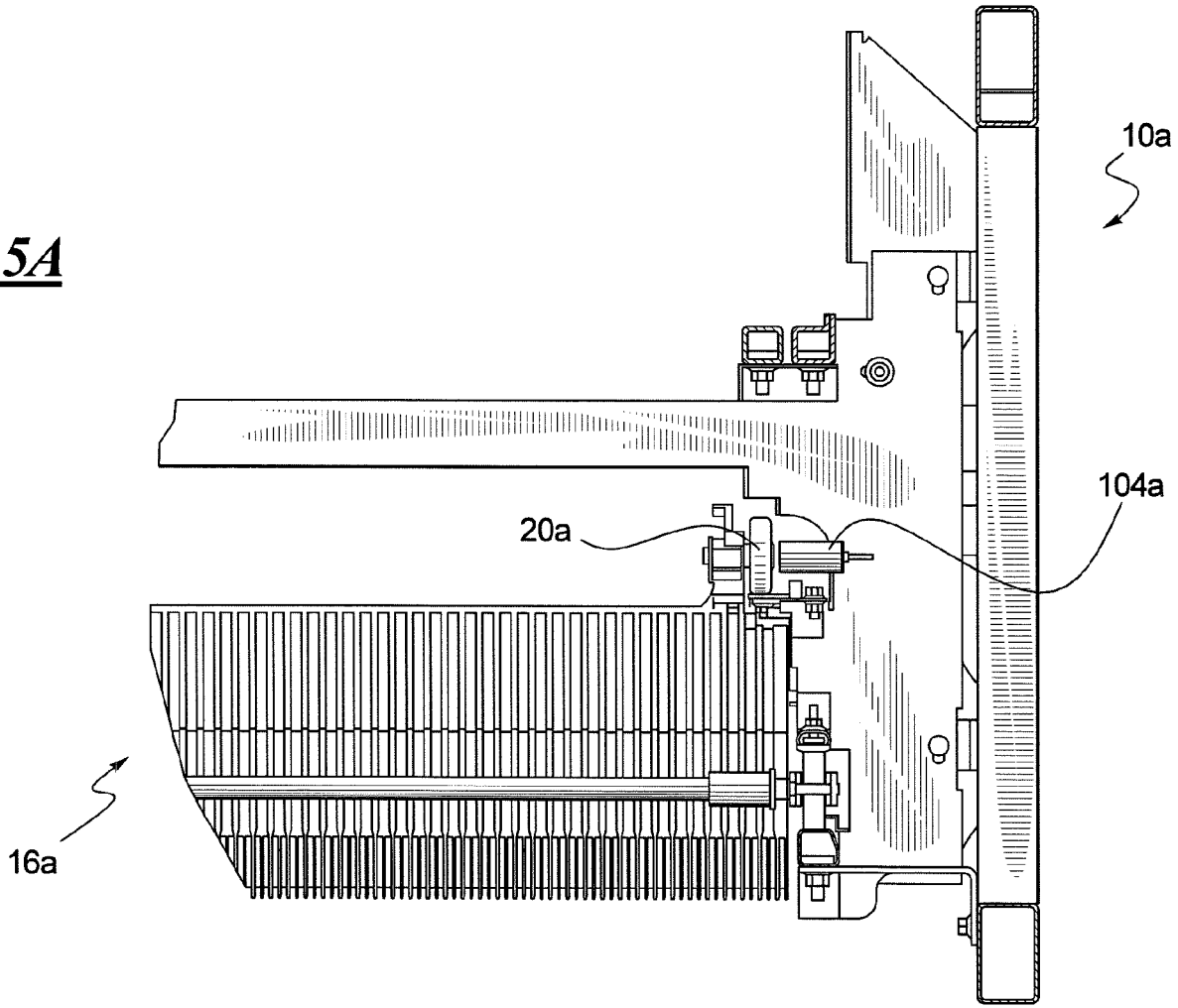
FIGS. 5A-5C are various views of a sensor positioned to detect a step roller axis of an escalator step.
Figure 5B:
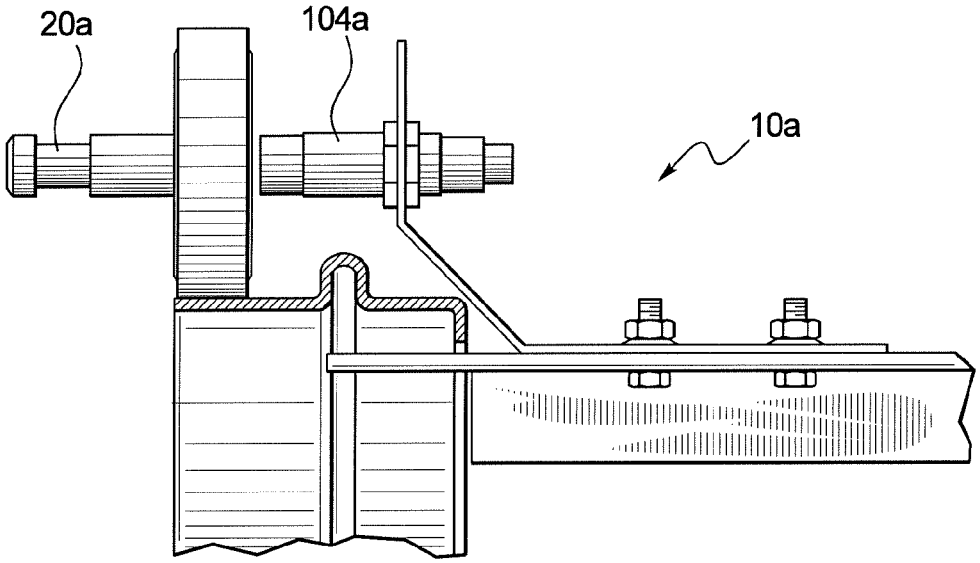
Figure 5C:
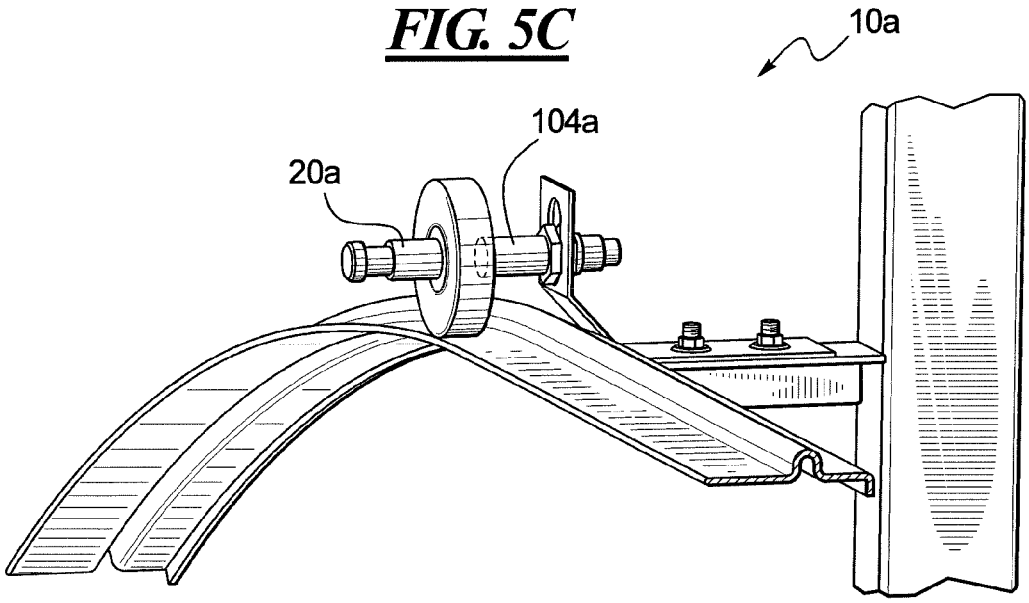
Figure 6A:
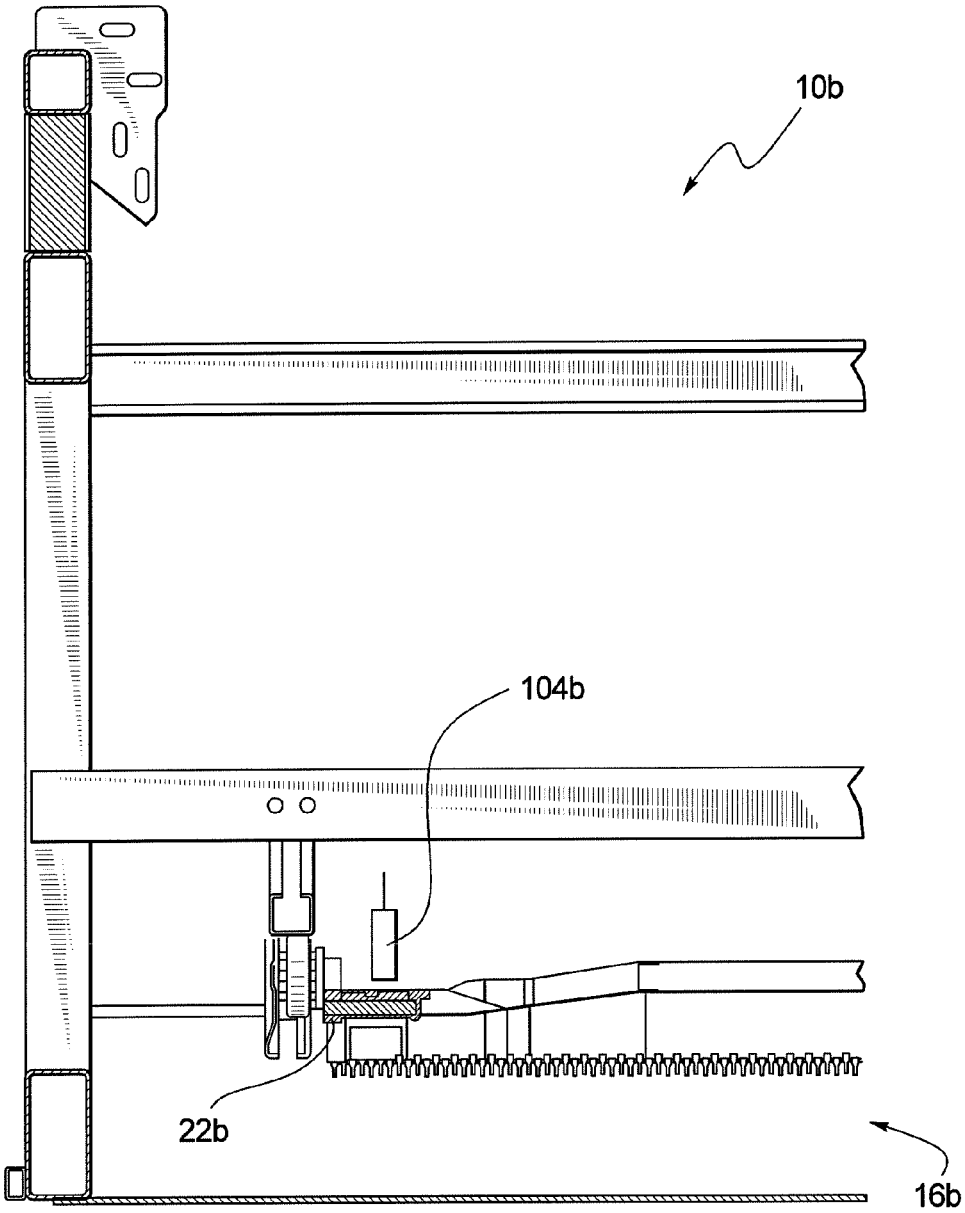
FIGS. 6A-6C are various views of a sensor positioned to detect a rear eye pallet moving pathway.
Figure 6B:
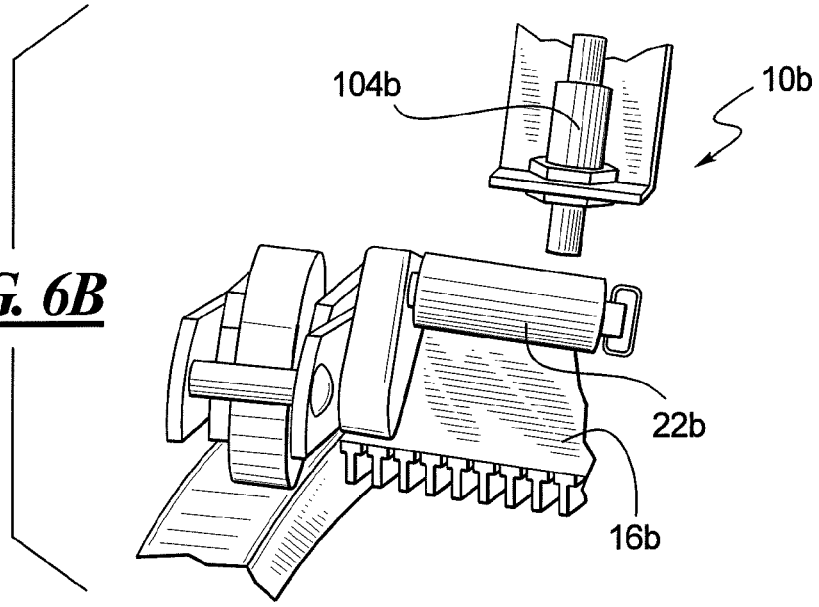
Figure 6C:
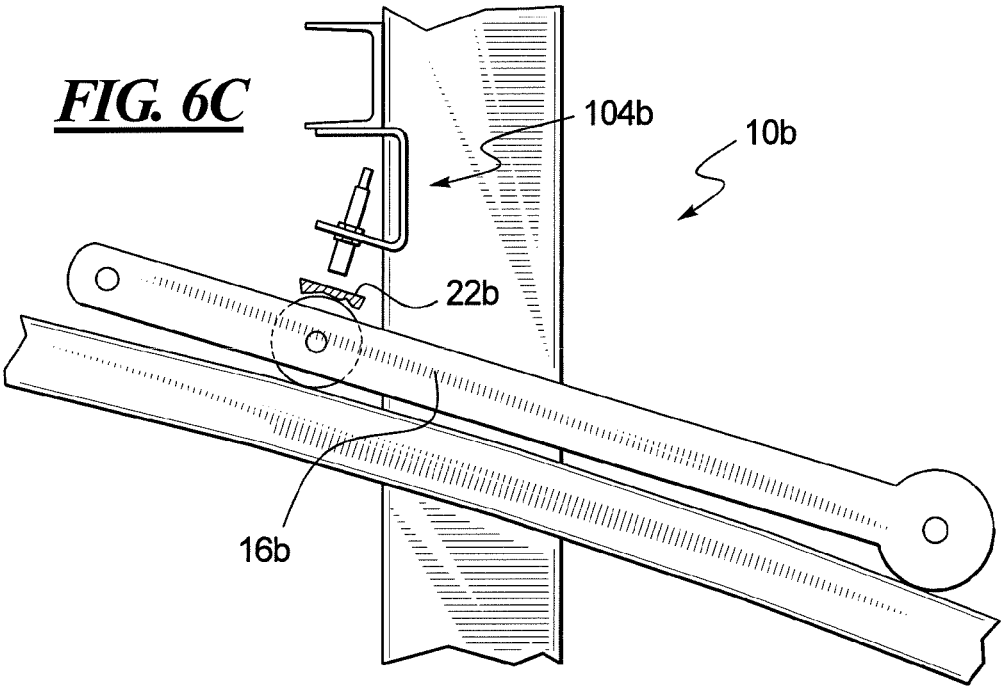

Turning to FIGS. 4A and 4B, sample timing diagrams are provided to demonstrate one method by which the pulse to pitch ratio and phase difference between step pulse signals may be determined. Signal A of FIG. 4A illustrates the drive pulse signal of the conveyor 10 at a first speed. Signals B and C illustrate step pulse signals representative of the steps detected at the first and second platforms 12, 14, respectively. In accordance with the method as outlined in FIG. 3, it is possible to correlate these pulse signals to result in fixed values, namely the pulse to pitch ratio and the phase difference. For instance, by counting the number of drive pulses in Signal A which occur between consecutive step pulses in either Signal B or C, the pulse to pitch ratio is determined to be 3:1. Furthermore, by comparing the phase shift between Signals B and C, the phase difference is determined to be $2\pi/3$ radians or 120°.

Similar analyses of Signals D, E and F of FIG. 4B, which illustrate the drive pulse signal of conveyor 10 at a second speed that is half the drive speed of the example of FIG. 4A, and step pulse signals representative of the steps detected at first and second platforms 12, 14 respectively, result in substantially the same results. Specifically, the number of drive pulses in Signal D which occur between consecutive step pulses in either Signal E or F is determined to be 3:1 and the phase difference between Signals E and F is $2\pi/3$ radians or 120°, as in the example of FIG. 4A. The pulse to pitch ratio and the phase difference between step pulse signals remain fixed for a particular conveyor 10 regardless of conveyor speed, acceleration, deceleration, and the like. However, if a step 16 is missing, misaligned and/or undetected, it will cause an immediate change to the pulse to pitch ratio as well as the phase difference between the step pulse signals of the first and second platforms 12, 14. Accordingly, the missing step detector 100 may be configured to respond if and only if there is are significant deviations in both the pulse to pitch ratio and the phase difference between step pulse signals.

In order to ensure accurate detection of missing steps and to effectively apply the signal correlation methods disclosed herein, the step detection sensors 104, 106 of the missing step detector 100 should be configured properly. For example, a missing step detector 100 may require inductive proximity sensors which exhibit changes in electrical characteristics in the presence of metal. The missing step detector 100 may also require the inductive sensors to output alternating signals. However, an inductive sensor that is configured to react to any and all of the metal in a passing step, will output a non-alternating continuous signal for the full pitch of the step, and thus, for the full length of the associated step chain. Accordingly, the sensors must be configured and carefully positioned so as to react to only a small portion of a passing step to enable a non-continuous alternating output, as shown in FIGS. 5A-5C and 6A-6C. In the exemplary embodiments of FIGS. 5A-5C, the proximity sensor 104*a* of an escalator type conveyor 10*a* is sized to target only the step roller axis 20*a* of a passing step 16*a* and placed in substantially close proximity to the path of the step roller axis 20*a*. In the exemplary embodiments of FIGS. 6A-6C, the proximity sensor 104*b* of a moving pathway or conveyor 10*b* is sized to target only the rear eye pallet 22*b* of a passing pallet or step 16*b* and placed in substantially close proximity to the path of the rear eye pallet 22*b*.

Based on the foregoing, it can be seen that the present disclosure may provide conveyors, such as escalators, travelators, moving walkways, and the like, with missing step detection systems that overcome deficiencies in the prior art. More specifically, the present disclosure provides means for determining an alternating drive pulse signal representative of conveyor speed, determining pulse signals representative of steps detected at each landing platform, and correlating the signals for the purposes of detecting misaligned or missing steps. By correlating sensor output signals of a conveyor, it is possible to determine fixed reference values or characteristics specific to the conveyor in question. The fixed values may include, for example a drive pulse to step pitch ratio and a phase difference between step pulse signals, and are indifferent to conveyor speed and time. By using more than one fixed value as reference, the present disclosure provides redundancy and missing step detection at any speed or acceleration of the conveyor. Furthermore, by providing sensor output in the form of alternating pulse signals, it is possible to construct a conveyor in full compliance with current safety standards and regulations without the need for costly certified sensors for gauging integrity.

While only certain embodiments have been set forth, alternatives and modifications will be apparent from the above description to those skilled in the art. These and other alternatives are considered equivalents and within the spirit and scope of this disclosure.

What is claimed is:

1. An apparatus for detecting a missing or misaligned step of a conveyor extending between a first platform and a second platform, comprising:

at least one drive speed sensor configured to detect a drive speed and output a drive pulse signal corresponding to the drive speed;

at least one first step sensor and at least one second step sensor, the first step sensor configured to detect each step at the first platform and outputting a first step pulse signal corresponding to the steps at the first platform, the second step sensor configured to detect each step at the second platform and outputting a second step pulse signal corresponding to the steps at the second platform; and a control unit that receives the drive pulse signal and first and second step pulse signals, the control unit being configured to determine a frequency of the drive pulse signal, determine a ratio of drive pulses per step pitch based on the frequency of the drive pulse signal and at least one of the first step pulse signal and the second step pulse signal, determine a phase difference between the first and second step pulse signals, monitor the pulses per step pitch ratio and the step pulse signal phase difference for variance, and provide instructions to adjust operation of the conveyor in response to detected variance.

2. The apparatus of claim 1, wherein the control unit provides instructions to adjust operation of the conveyor only in response to detected variance in both the pulses per step pitch ratio and the step pulse signal phase difference.

3. The apparatus of claim 1, wherein each of the first and second step sensors is configured to detect only a step roller axis of each step at the respective platform.

4. The apparatus of claim 1, wherein each of the first and second step sensors is configured to detect only a rear eye pallet of each step at the respective platform.

5. The apparatus of claim 1, wherein at least one of the step sensors is configured to detect only a step roller axis of each step at the respective platform and at least one of the step sensors is configured to detect only a rear eye pallet of each step at the respective platform.

6. The apparatus of claim 1, wherein each of the ratio of pulses per step pitch and the step pulse signal phase difference remains substantially constant during acceleration and deceleration of the conveyor.

7. The apparatus of claim 1, wherein the drive speed sensor is an encoder.

8. The apparatus of claim 1, wherein the drive speed sensor is a proximity sensor.

9. The apparatus of claim 1, wherein each of the first and second step sensors is a proximity sensor.

10. The apparatus of claim 8, wherein each of the first and second step sensors is an inductive sensor.

11. The apparatus of claim 1 further comprising handrail speed sensors.

12. A method for detecting a missing or misaligned step of a conveyor extending between a first platform and a second platform, comprising the steps of:

determining a drive pulse signal corresponding to a speed of the conveyor;

determining a first step pulse signal corresponding to the steps at the first platform;

determining a second step pulse signal corresponding to the steps at the second platform;

determining a frequency of the drive pulse signal;

determining a ratio of drive pulses per step pitch based on the frequency of the drive pulse signal and at least one of the first step pulse signal and the second step pulse signal;

determining a phase difference between the first and second step pulse signals;

monitoring each of the pulses per step pitch ratio and the step pulse signal phase difference for variance; and providing instructions to adjust operation of the conveyor in response to detected variance.

13. The method of claim 12, wherein the step of providing instructions to adjust operation of the conveyor only occurs in response to detected variance in both the pulses per step pitch ratio and the step pulse signal phase difference.

14. The method of claim 12, wherein each of the first and second step pulse signals corresponds to a step roller axis of each step at the respective platform.

15. The method of claim 12, wherein each of the first and second step pulse signals corresponds to a rear eye pallet of each step at the respective platform.

16. The method of claim 12, wherein at least one of the step pulse signals corresponds to a step roller axis of each step at the respective platform and at least one of the step pulse signals corresponds to only a rear eye pallet of each step at the respective platform.

17. The method of claim 12, wherein each of the ratio of drive pulses per step pitch and the phase difference between the first and second step pulse signals remains substantially constant during acceleration and deceleration of the conveyor.

* * * * *